US005192205A

United States Patent [19]

Iwahori

[11] Patent Number: 5,192,205

[45] Date of Patent: Mar. 9, 1993

[54] DEVICE FOR THE GASIFICATION AND FLOW CONTROL OF LIQUIFIED PETROLEUM GAS

[76] Inventor: Masayuki Iwahori, 15-19, Nakada Honmachi, Shizuoka-ken, Japan

[21] Appl. No.: 736,737

[22] Filed: Jul. 26, 1991

[30] Foreign Application Priority Data

Aug. 17, 1990 [JP] Japan ..... 2-217330

[51] Int. Cl.[5] ..... F23D 14/28

[52] U.S. Cl. ..... 431/344; 222/3; 137/550

[58] Field of Search ..... 431/344; 222/3; 137/550

[56] References Cited

U.S. PATENT DOCUMENTS

| | | | |
|---|---|---|---|
| 4,101,262 | 7/1978 | Neyret | 431/344 |
| 4,478,570 | 10/1984 | Johansson | 431/344 |
| 4,929,175 | 5/1990 | Nitta | 137/550 X |
| 5,071,343 | 12/1991 | Lloverts-Capilla | 431/344 |

FOREIGN PATENT DOCUMENTS

| | | | |
|---|---|---|---|
| 0324654 | 7/1989 | European Pat. Off. | 431/344 |

*Primary Examiner*—Carl D. Price
*Attorney, Agent, or Firm*—Harrison & Egbert

[57] ABSTRACT

A device for the gasification and flow control of liquified petroleum gas (hereinafter referred to as "LPG") in an apparatus such as a gas lighter for cigars and cigarettes, a gas igniter and a portable gas torch, said apparatus comprising a pressure container, a valve and a nozzle, said pressure container containing LPG, said LPG being subjected to gasification and flow control when said valve is opened, gasified LPG being emitted through said nozzle. The improvements comprise an orifice having a diameter of about 30 to 200 μm and a microporous film having a hydrophobic property, said orifice being disposed at an upstream side of said valve, said microporous film being disposed at an upstream of said orifice. An unwoven fabric having a thickness of about 0.1 to 0.3 mm is preferably disposed between said orifice and said microporous film. A valve seat may be provided with an opening having a diameter of about 30 to 200 μm, said opening serving as an orifice. The device of the invention stabilizes the amount of emission of gas.

10 Claims, 2 Drawing Sheets

DEVICE FOR THE GASIFICATION AND FLOW CONTROL OF LIQUIFIED PETROLEUM GAS

BACKGROUND OF THE INVENTION (a) Field of the Invention

The present invention relates to a device for the gasification and flow control of liquefied petroleum gas (hereinafter referred to as "LPG") in an apparatus such as a gas lighter for cigars and cigarettes, a gas igniter and a portable gas torch, said apparatus comprising a pressure container, a valve and a nozzle, said pressure container containing LPG, said LPG being subjected to gasification and flow control when said valve is opened, gasified LPG being emitted through said nozzle.

(b) Description of the Prior Art

The following are conventional devices for the gasification and flow control of LPG in an apparatus comprising a pressure container, a valve and a nozzle, said pressure container containing LPG, said LPG being subjected to gasification and flow control when said valve is opened, gasified LPG being emitted through said nozzle.

(1) A device adapted to perform the gasification and flow control of LPG by means of a compressed porous elastic material. LPG is subjected to gasification and flow control when it passes through the compressed porous elastic material.

(2) A device adapted to perform the gasification and flow control of LPG by means of a microporous film only, as disclosed by Japanese Patent Laid-Open Publication No. Sho 51-148576. This publication also shows an embodiment in which a space called gasification chamber is disposed at a downstream side of said microporous film.

The above-mentioned device (1) adapted to perform the gasification and flow control of LPG by means of a compressed porous elastic material has an advantage that it is possible to adjust the flow of LPG. However, in this device, the amount of emission of gasified LPG has a tendency to vary with the lapse of time because the property of said elastic material changes with the lapse of time. Therefore, it is necessary to determine the flame length at the time of manufacture on the basis of an expectation as to how the flame length will vary with the lapse of time. It is very difficult to do so.

The above-mentioned device (2) adapted to perform the gasification and flow control of LPG by means of a microporous film only has been developed with a view to obviating the aforesaid disadvantage of the device (1). However, when the device (2) is applied to an apparatus such as a gas lighter for cigars and cigarettes, a gas igniter and a portable gas torch, the effective penetration diameter of the microporous film (the diameter of a portion of the microporous film through which portion LPG can pass) is as small as about 2 to 5 mm. Since the effective penetration area of the microporous film (the area of a portion of the microporous film through which portion LPG can pass) is proportional to the square of the effective penetration diameter thereof, even slight variations of the effective penetration diameter of the microporous film change the flow of LPG very much. Therefore, in the above-mentioned device (2) adapted to perform the gasification and flow control of LPG by means of the microporous film only, the unevenness of the effective penetration diameter of the microporous film causes the amount of emission of gasified LPG to vary. Furthermore, in said device (2) adapted to perform the gasification and flow control of LPG by means of the microporous film only, the amount of emission of gasified LPG is directly influenced by the variations of vapor pressure within the pressure container which are caused by the changes of ambient temperature (external temperature). When the ambient temperature is low, the amount of emission of gasified LPG has a tendency to become too small. When the ambient temperature is high, the amount of emission of gasified LPG has a tendency to become too large. This may cause disadvantages or dangers of ignition miss or forming a too small or too large flame.

Said gasification chamber of the above-mentioned device (2) is a space disposed at a downstream side of said microporous film so as to obtain a fixed effective penetration area of the microporous film. In this embodiment, however, LPG is liable to be condensed into small drops of liquid which may gush out when the valve is opened.

SUMMARY OF THE INVENTION

It is an object of the invention to provide a device for the gasification and flow control of LPG which has obviated all the disadvantages of the above-mentioned prior art.

It is another object of the invention to provide a device for the gasification and flow control of LPG which minimizes the variations of the amount of emission of gasified LPG caused by the variations of the effective penetration area of the microporous film.

It is a further object of the invention to provide a device for the gasification and flow control of LPG which minimizes the variations of the amount of emission of gasified LPG caused by the variations of the ambient temperature.

It is a further object of the invention to provide a device for the gasification and flow control of LPG which always gives a stable amount of emission of gasified LPG.

It is a further object of the invention to provide a device for the gasification and flow control of LPG in which the amount of emission of gasified LPG is not changed with the lapse of time.

It is a further object of the invention to provide a device for the gasification and flow control of LPG which gasifies LPG completely.

It is a further object of the invention to provide a device for the gasification and flow control of LPG which obviates the danger of a too large flame being caused by the condensation of LPG.

It is a further object of the invention to provide a device for the gasification and flow control of LPG which is composed of a smaller number of parts and easier to assemble.

To achieve the above-mentioned objects, the present invention provides a device for the gasification and flow control of LPG, said device being provided at an upstream side of the valve with an orifice having a certain diameter and a microporous film having a hydrophobic property. To say more precisely, the present invention provides a device for the gasification and flow control of LPG in an apparatus comprising a pressure container, a valve and a nozzle, said pressure container containing LPG, said LPG being subjected to gasification and flow control when said valve is opened, gasified LPG being emitted through said nozzle, the improvements comprising an orifice having a diameter of about 30 to 200 μm and a microporous film having a hydrophobic property, said orifice being disposed at an upstream side of said valve, said microporous film being disposed at an upstream of said orifice.

An unwoven fabric having a thickness of about 0.1 to 0.3 mm is preferably disposed between said orifice and said microporous film.

A valve seat may be provided with an opening having a diameter of about 30 to 200 μm, said opening serving as an orifice. In this case, the above-mentioned orifice is dispensed with. An unwoven fabric having a thickness of about 0.1 to 0.3 mm is preferably disposed between said valve seat and said microporous film.

The device for the gasification and flow control of LPG according to claim 1 operates as follows: When the valve is opened, LPG first passes through the microporous film having a hyrdophobic property. At this time, the LPG is subjected to evaporation and flow control by said microporous film. In the present invention, the microporous film having a hydrophobic property is used. If a microporous film having a hydrophilic property is used, LPG in a liquid phase penetrates the microporous film very easily, and therefore the flow of LPG is much different according as the LPG passes through the microporous film in a liquid phase or in a vapor phase. This means that the effect of flow control by the orifice, which is described later, is not achieved enough.

The LPG subjected to gasification and flow control by the microporous film is further subjected to flow control by the orifice having a diameter of about 30 to 200 μm. In general, as the ambient temperature rises and the vapor pressure within the pressure container increases, the amount of emission of gasified LPG is larger. As the ambient temperature falls and the vapor pressure within the pressure container decreases, the amount of emission of gasified LPG is smaller. In the present invention, as the ambient temperature rises and the vapor pressure within the pressure container increases, the orifice controls flow more effectively and limits the amount of emission of gasified LPG. As the ambient temperature falls and the vapor pressure within the pressure container decreases, the orifice in the present invention performs less or no function of flow control and allows gasified LPG to pass almost freely or freely. This is because the orifice controls flow more effectively as the difference between the primary pressure (pressure at an upstream side of the orifice) and the secondary pressure (pressure at a downstream side of the orifice) increases, and the orifice performs less or no function of flow control as the difference between the primary pressure and the secondary pressure is decreased. Thus, the orifice decreases the variations of the amount of emission of gasified LPG which are caused by the changes of the ambient temperature.

The diameter of the orifice should be in a range of about 30 to 200 μm because the device of the invention is applied to an apparatus such as a gas lighter for cigars and cigarettes, a gas igniter and a portable gas torch. If the diameter of the orifice is below about 30 μm, the role of flow control played by the orifice is relatively large as compared with the role of flow control played by the microporous film, and therefore the flow of gasified LPG is much influenced by the variations of the diameter of the orifice. Also, if the diameter of the orifice is below about 30 μm, the orifice may be clogged with dust or other foreign matters mixed in LPG. If the diameter of the orifice is above about 200 μm, it is impossible to control the flow of gasified LPG to a degree suitable for an apparatus such as a gas lighter for cigars and cigarettes, a gas igniter and a portable gas torch.

The device of the invention comprises both the microporous film and the orifice. Therefore, even if there are variations in the effective penetration area of the microporous film, the orifice performs the function of flow control when the flow is too large, and the orifice performs less or no function of flow control and allows gasified LPG to pass almost freely or freely when the flow is too small. In a case where the ambient temperature is constant but there are variations in the effective penetration area of the microporous film, in said device adapted to perform the gasification and flow control of LPG by means of a microporous film only, the variations in the effective penetration area of the microporous film directly appear as variations in the flow of gasified LPG, while in the device of the present invention adapted to perform the gasification and flow control of LPG by means of both the microporous film and the orifice, the orifice also performs the function of flow control and the variations in the flow of gasified LPG are reduced.

In the device for the gasification and flow control of LPG according to the present invention, the amount of emission of gasified LPG is not changed with the lapse of time.

From the above, it is apparent that the device for the gasification and flow control of LPG according to the present invention always gives a stable amount of emission of gasified LPG.

In the device for the gasification and flow control of LPG according to claim 2, said device comprising an unwoven fabric having a thickness of about 0.1 to 0.3 mm disposed between said orifice and said microporous film, LPG subjected to evaporation and flow control by said microporous film is gasified more completely when it passes through the unwoven fabric because the LPG receives heat of evaporation from ambient members and the pressure thereof is reduced. Since it is not necessary to provide a space to obtain a certain effective penetration area of the microporous film, it is possible to obviate the danger of a too large flame being caused by the condensation of LPG.

If the thickness of the unwoven fabric is below 0.1 mm, the unwoven fabric does not perform the above-mentioned function well. If the thickness of the unwoven fabric is above 0.3 mm, the LPG once evaporated may liquefy again within the unwoven fabric and such small drops of liquid may gush out when the valve is opened. This is very dangerous.

The device for the gasification and flow control of LPG according to claim 3 is the same as the device of claim 1 except that the valve seat and the orifice are unified, and operates in the same way as in the device of claim 1. This device is composed of a smaller number of parts and easier to assemble.

The device for the gasification and flow control of LPG according to claim 4 is the same as the device of claim 2 except that the valve seat and the orifice are unified, and operates in the same way as in the device of claim 2.

DETAILED DESCRIPTION

The present invention will now be described in detail with reference to the attached drawings.

Figure 1:
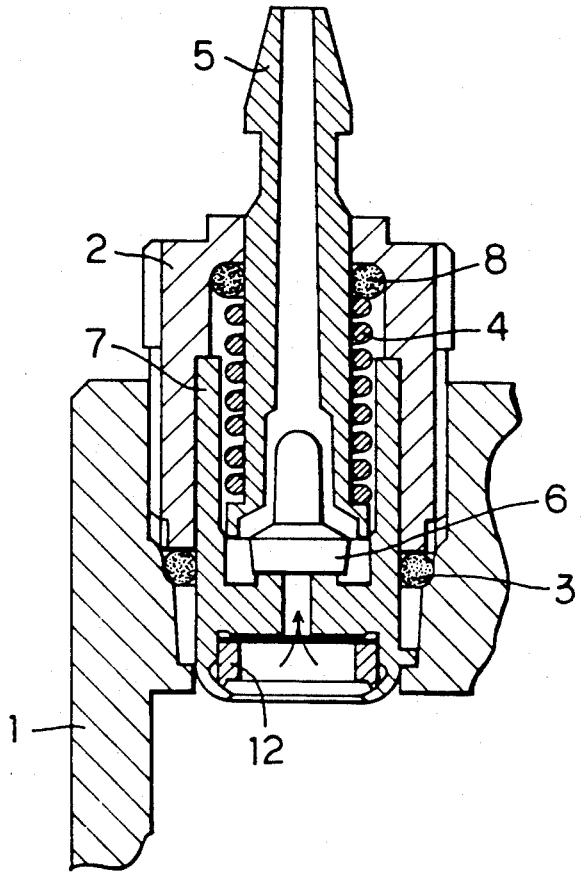
FIG. 1 is a sectional view showing an embodiment of the present invention.

The device for the gasification and flow control of LPG according to the present invention forms a part of an apparatus such as a gas lighter for cigars and cigarettes, a gas igniter and a portable gas torch, said apparatus comprising a pressure container, a valve and a nozzle, said pressure container containing LPG, said LPG being subjected to gasification and flow control when said valve is opened, gasified LPG being emitted through said nozzle. This apparatus will be described first. This apparatus comprises, as shown in FIG. 1, a pressure container 1, a valve mechanism casing 2 fixed through an O ring 3 to said pressure container 1, a valve 6 and a valve seat 7 being respectively disposed within said valve mechanism casing 2, a nozzle 5 being inserted through an O ring 8 into said valve mechanism casing 2 in such a state that an end of said nozzle 5 protrudes from said valve mechanism casing 2, said nozzle 5 being provided with a return spring 4 for returning said nozzle 5 to its original position.

The device for the gasification and flow control of LPG according to the present invention will now be described.

The device for the gasification and flow control of LPG according to the present invention is provided at an upstream side (lower side in FIG. 1 and FIG. 2) of the valve 6 with an orifice member 9 which has an orifice or opening 9*a* having a diameter of about 30 to 200 μm, preferably about 120 to 150 μm, and a microporous film 11 having a hydrophobic property, said microporous film 11 being disposed at an upstream of said orifice member 9. The diameter of the orifice 9*a* is decided within a range of about 30 to 200 μm, preferably about 120 to 150 μm, in view of the composition of LPG, the characteristics of the microporous film 11, the effective penetration diameter (the inner diameter α of a holder 12, described later, in FIG. 4) of the microporous film 11, a desired amount of emission of gasified LPG, etc. The orifice member 9 is made of nickel alloy for example. The microporous film 11 is made of polypropylene for example and is provided with a large number of pores having a size of about 0.1 to 0.01 μm for example. It is to be noted that these pores do not have to be round.

Figure 2:
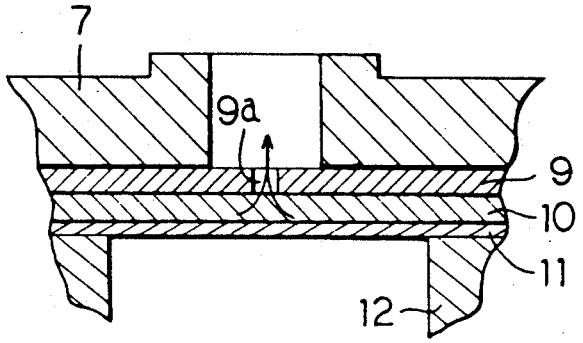
FIG. 2 is an enlarged sectional view showing a part of the same.

In FIG. 2, an unwoven fabric 10 having a thickness of about 0.1 to 0.3 mm is disposed between said orifice 9*a* and said microporous film 11. The unwoven fabric 10 is made of, for example, a synthetic fiber such as polypropylene, nylon and polyethylene, a natural fiber, a glass fiber, etc.

In FIG. 1 and FIG. 2, the orifice member 9, the unwoven fabric 10 and the microporous film 11 are held in place by an annular holder 12 which is supported by means of a annular bent edge of said valve seat 7.

Figure 4:
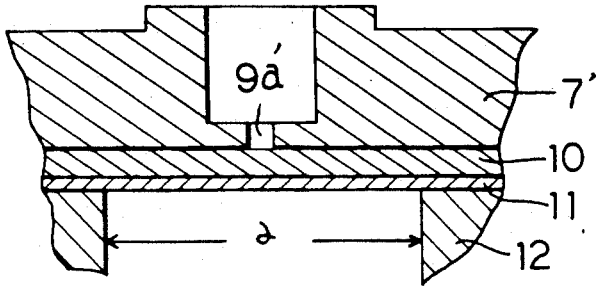
FIG. 4 is an enlarged sectional view, similar to FIG. 2, showing another embodiment of the present invention.

A valve seat 7' shown in FIG. 4 is provided with an opening 9*a*' having a diameter of about 30 to 200 μm, said opening 9*a*' serving as an orifice. The opening 9*a*' may be bored by means of a laser beam for example.

In the device for the gasification and flow control of LPG according to the present invention, when LPG arrives at the microporous film 11, LPG in a gaseous phase is subjected to flow control by the microporous film 11 and moves to the orifice 9*a* of the orifice member 9, LPG in a liquid phase being subjected to evaporation and flow control by the microporous film 11 having a hydrophobic property, evaporated LPG moving to the orifice 9*a* of the orifice member 9. In the device comprising said unwoven fabric 10 disposed between the orifice 9*a* and the microporous film 11, when LPG evaporated by the microporous film 11 passes through the unwoven fabric 10, the LPG is supplied with heat of evaporation by ambient members, particularly the orifice member 9 and the valve seat 7, and completely gasified. Gasified LPG is subjected to flow control by the orifice 9*a* and emitted through the nozzle 5.

Figure 3:
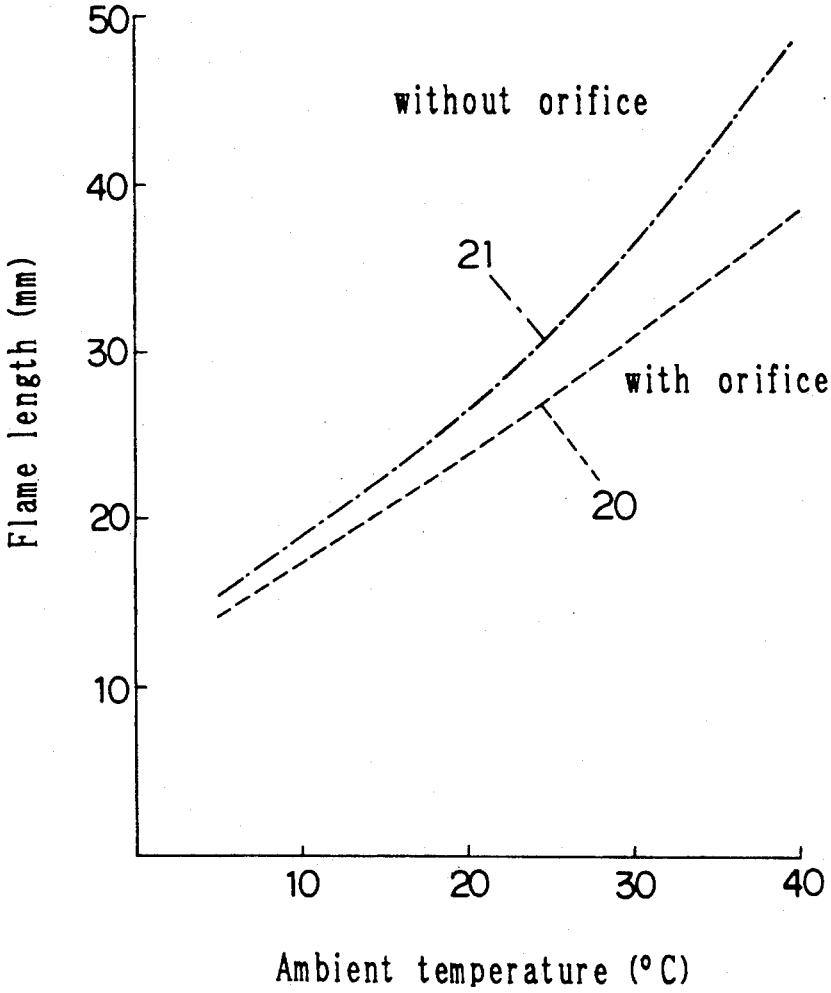
FIG. 3 is a graph showing the relationship between the ambient temperature and the flame length in a case where an orifice is used and a case where no orifice is used.

As mentioned above, as the ambient temperature rises and the vapor pressure within the pressure container increases, the orifice 9*a* controls flow more effectively and limits the amount of emission of gasified LPG. Also, as the ambient temperature falls and the vapor pressure within the pressure container decreases, the orifice 9*a* performs less or no function of flow control and allows gasified LPG to pass almost freely or freely. The inventor made experiments concerning these points, the results of which are shown in FIG. 3.

The experiments were made by means of the device shown in FIG. 1 and FIG. 2 in which microporous films having effective penetration diameters of 2.5 mm, 2.6 mm and 2.7 mm were used. Fuel used was an LPG comprising butane and propane, said LPG having a vapor pressure of about 2 kg/cm$^2$ at a temperature of 23° C. Measurements were made of the lengths of flames formed by emitted gas. In FIG. 3, a line 20 shows a case where an orifice having a diameter of 120 to 150 μm is used (hereinafter referred to as "case with orifice"), and a line 21 shows a case where no orifice is used (hereinafter referred to as "case without orifice"). When the ambient temperature (the pressure within the pressure container increases as the ambient temperature rises and decreases as the ambient temperature falls) was low, the case without orifice showed a flame slightly longer than the case with orifice, the difference in flame length between the two cases being very small. With the rise of the ambient temperature, the flame in the case without orifice became much longer than the flame in the case with orifice, the difference in flame length between the two cases being much larger. When the ambient temperature was 40° C., the flame length in the case with orifice was only 79% of the flame length in the case without orifice. From the above, it is apparent that the variations of flame length (the variations of the amount of emission of gas) by the changes of the ambient temperature in the case with orifice is smaller than those in the case without orifice.

What is claimed is:

1. An improved device for the gasification and flow control of liquefied petroleum gas in an apparatus comprising a pressure container, a valve and a nozzle, the valve having a passage into the nozzle, said pressure container containing liquefied petroleum gas, said liquefied petroleum gas being subjected to gasification and flow control when said valve is opened such that gasified liquefied petroleum gas is emitted through said passage and through said nozzle, the improvement comprising:

an orifice having a diameter of between 30 and 200 μm; and a microporous film having a hydrophobic property, said orifice being disposed at an upstream side of said valve, said orifice opening to the passage of said valve, said microporous film being disposed at an upstream of said orifice.

2. A improvement as claimed in claim 1, wherein an unwoven fabric having a thickness of about 0.1 to 0.3 mm is disposed between said orifice and said microporous film.

3. The improvement of claim 1, said passage extending through a valve seat supporting said valve, said orifice formed through a member positioned against a surface of said valve seat.

4. The improvement of claim 3, said member being positioned between said microporous film and said valve seat.

5. The improvement of claim 1, said passage having a diameter greater than a diameter of said orifice.

6. The improvement of claim 3, said orifice being exterior of said valve seat, said orifice communicating with said passage in said valve seat.

7. An improved device for the gasification and flow control of LPG in an apparatus comprising a pressure container, a valve and a nozzle, said valve having a passage to said nozzle, said pressure container containing LPG, said LPG being subjected to gasification and flow control when said valve is opened such that gasified LPG is emitted through said passage and through said nozzle, the improvement comprising:

a valve seat being provided with an opening having a diameter of between 30 and 200 μm, said valve seat having said passage extending therethrough, said opening being an orifice communicating with said passage; and a microporous film being disposed at an upstream side of said valve seat, said microporous film having a hydrophobic property.

8. A improvement as claimed in claim 7, wherein an unwoven fabric having a thickness of about 0.1 to 0.3 mm is disposed between said valve seat and said microporous film.

9. The improvement of claim 3, said valve having a valve seat, said passage extending through said valve seat, said orifice formed on an end of said valve seat.

10. The improvement of claim 9, said orifice having a diameter less than a diameter of said passage.

* * * * *